United States Patent [19]

Beccario

[11] 4,005,432

[45] Jan. 25, 1977

[54] COMMUTATED LOG PERIODIC ANTENNA ARRAY FOR AUTOMATIC DIRECTION FINDING

[75] Inventor: Michael J. Beccario, Cedar Rapids, Iowa

[73] Assignee: Rockwell International Corporation, El Segundo, Calif.

[22] Filed: Nov. 11, 1975

[21] Appl. No.: 630,831

[52] U.S. Cl. ..... 343/792.5; 343/876

[51] Int. Cl.[2] ..... H01Q 3/24

[58] Field of Search ..... 343/854, 876, 810, 811, 343/812, 814, 815, 100 SH, 844, 879

[56] References Cited

UNITED STATES PATENTS

| | | | |
|---|---|---|---|
| 3,157,878 | 11/1964 | Hansel et al. | 343/876 |
| 3,213,458 | 10/1965 | Hansel et al. | 343/854 |
| 3,400,405 | 9/1968 | Patterson | 343/854 |
| 3,790,950 | 2/1974 | Smith et al. | 343/792.5 |
| 3,883,875 | 5/1975 | McClymont et al. | 343/876 |

*Primary Examiner*—Eli Lieberman
*Attorney, Agent, or Firm*—Howard R. Greenberg; Robert J. Crawford

[57] ABSTRACT

A plurality of log periodic antennas are arranged in a commutated antenna array to amplitude modulate an RF signal for providing bearing information with respect to the signal direction in an automatic direction finding system.

5 Claims, 4 Drawing Figures

COMMUTATED LOG PERIODIC ANTENNA ARRAY FOR AUTOMATIC DIRECTION FINDING

BACKGROUND OF THE INVENTION

The present invention pertains generally to antennas and specifically to a commutated antenna array which has particular application for use in automatic direction finding systems.

Numerous automatic direction finding systems exist for providing navigational bearing information with respect to the direction of a radio (RF) signal as received from a transmitter having a known location. Some of these systems use a rotating antenna to physically rotate a cardioid pattern which is used to sinusoidally modulate the amplitude of the RF signal. By comparing the phase of the sinusoidal modulation imparted to the RF signal with that of a locally generated sinusoidal signal of the same frequency, and whose phase remains constant vis-a-vis the antenna angular deviation, the direction of the RF signal can be determined and bearing information ascertained.

Although it is known that a rotating pattern such as a cardioid can be electronically simulated by a commutated antenna array which obviates the need for a rotating antenna, this approach has not been widely adopted. The only such system of which the applicant is aware is one provided by Collins Radio Company of Canada, Ltd. for airborne navigation designated Direction Finder DF-301E (described in Instruction Manual No. 523-1000-429-1011-42) that uses a single antenna consisting of a cavity-backed disk separated from a ground plane by an annular slot having taps around its perimeter which are sequentially activated to generate the rotating cardioid pattern. Although effective for its intended purpose, this slotted antenna lacks the versatility necessary for extended use such as for surface navigation onboard ships. For example, its flat profile (3.6 inches in height) materially reduces its visibility to RF signals which may not significantly impair its operation for airborne navigation where one has the benefit of height but certainly would for surface navigation. Furthermore, the antenna gain which is affected by the size of the ground plane may be unduly limited by dimensional constraints on the antenna so that desired signals having reduced intensities may not be capable of being received and detected. Despite these shortcomings, the good directivity and high integrity for the cardioid pattern generated which are so important to achieve good direction finding performance are compensating factors exhibited in the DF-301E slotted antenna. The latter characteristic is attributable to the intrinsic operation of the slotted antenna, which unlike individual antenna arrays, substantially eliminates unwanted interaction effects created by signal reradiations that would otherwise distort the desired antenna cardioid pattern used in direction finding. Although these effects could be combatted by separating adjacent antennas by greater distances the resultant size of an individual antenna array efficacious for automatic direction finding could be too large to be useful.

With the foregoing in mind, it is a primary object of the present invention to provide a new and improved commutated antenna array for amplitude modulating an RF signal such as used for automatic direction finding.

It is a further object of the present invention to provide such a new and improved array which is highly versatile, yet displays all of the characteristics essential for direction finding.

It is still a further object of the present invention to provide such a new, improved and versatile array which may be realized in a small package without detrimental interaction effects.

These objects as well as others, and the means by which they are achieved through the present invention, may best be appreciated by referring to the Detailed Description of the Invention which follows together with the appended drawings.

BRIEF DESCRIPTION OF THE INVENTION

In accordance with the present invention, a plurality of log periodic antennas are arranged in a geometric pattern and sequentially connected by a commutating means to a common terminal via individual conductors associated therewith. The common terminal is connected to radio signal equipment such as a transmitter when the antenna array is used for transmitting or a receiver when the antenna array is used for receiving signals. The commutating means sequentially connects the antennas to the common terminal via their respective conductors to electronically simulate a rotating antenna directional pattern with which to amplitude modulate an RF signal to obtain bearing information with respect to its direction for navigational purposes. The commutating means also includes means for connecting the antenna conductors to individual terminating means associated therewith when not connected to the common terminal so as to minimize wave reflections which would otherwise be reradiated and distort the desired antenna pattern. In addition to the other characteristics suitable for direction finding, the log periodic antenna displays a constant impedance over a large frequency spectrum thereby permitting a good impedance match over a large operating range.

DETAILED DESCRIPTION OF THE INVENTION

Figure 1:
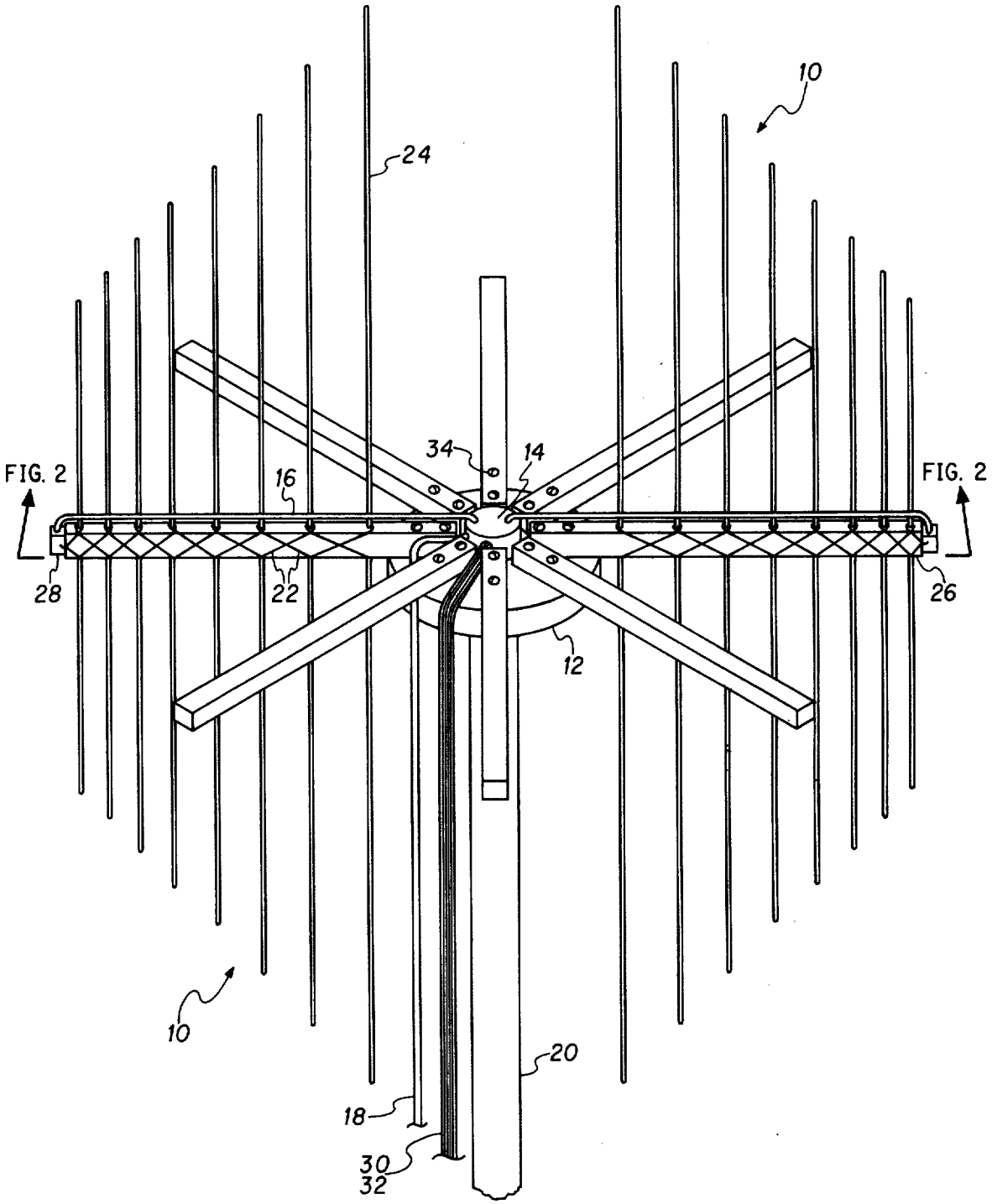
FIG. 1 is an isometric view of the antenna array of the invention wherein eight log periodic antennas are arranged in a circular geometric array (only two antennas shown in detail for clarity).

As shown in FIG. 1, eight log periodic antennas 10 (*a–h*) are symmetrically spaced in 45° increments in a circular array around a support plate 12 on which rests an enclosure 14 which houses electronic circuitry for providing a commutative action to sequentially connect the antennas 10 to radio signal equipment via individual coaxial cable conductors 16 and a common cable conductor 18 which runs down along the antenna support 20. The cables employed are standard with a center conductor and grounded (shielded) exterior. As will be appreciated by those skilled in the art, the circular geometrical array and uniform commutated switching imparts to a radio (RF) signal whether received or transmitted AM modulation whose frequency is the same as the commutation frequency. By comparing the phase of the modulation signal against that of a locally generated reference signal having the same frequency, the direction of the radio signal can be determined and then used to afford navigational information for automatic direction finding. The log periodic antenna has excellent broadband characteristics such as high gain and good directivity to render it highly suitable for this application.

Lead wires 22 are connected to alternate dipoles 24 along each antenna arm 26 in conventional fashion and then to their associated coaxial cable conductors 16 via individual balancing transformers 28 for interconnecting balanced and unbalanced impedances. Eight individual switching signal lead wires 30 and a D.C. source lead wire 32 are routed along the antenna support 20 to the electronic circuitry housed in enclosure 14 for controlling same to be explained shortly. Antenna arms 26 are affixed to support plate 12 by mounting screws 34.

Figure 2:
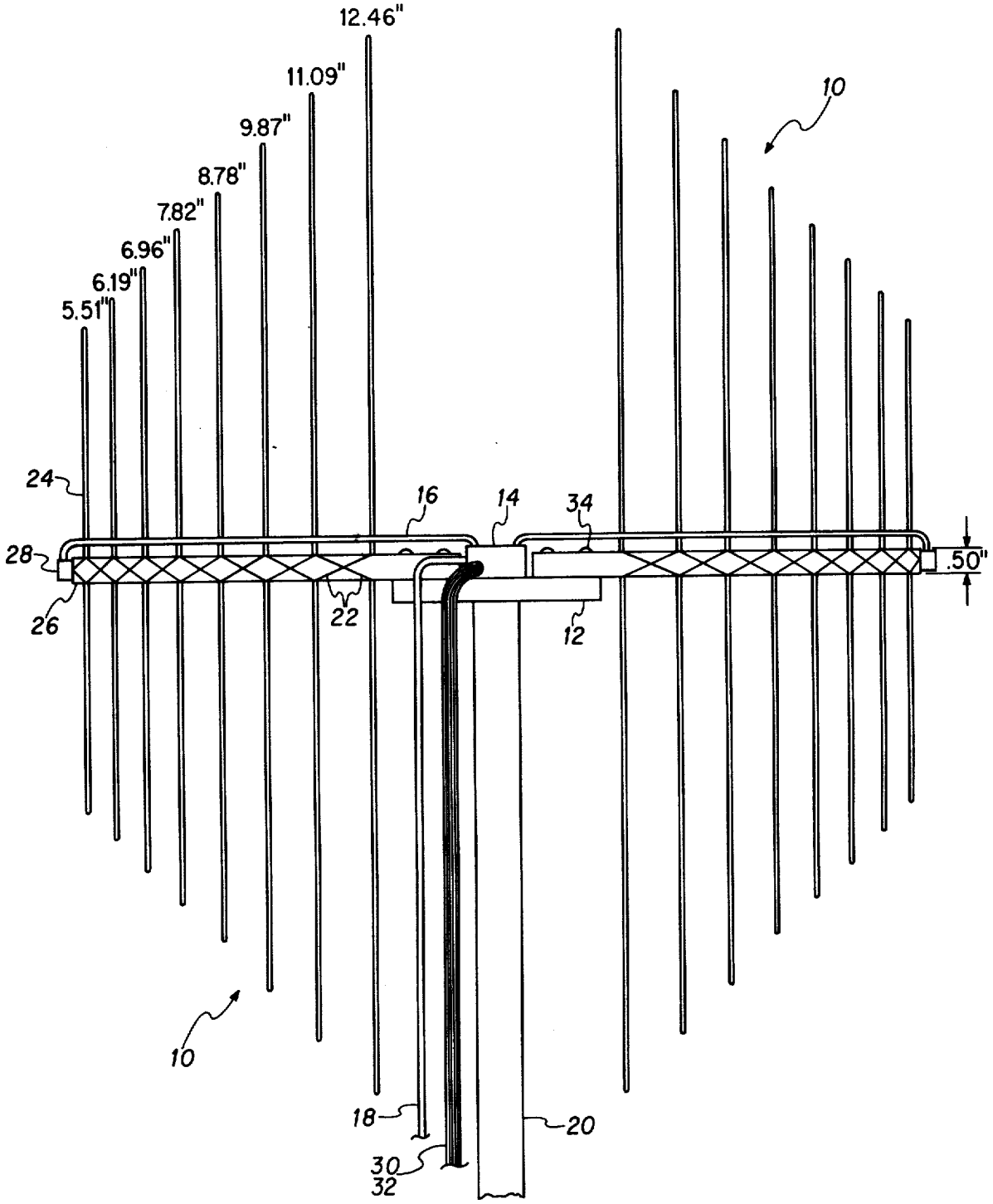
FIG. 2 is an elevation view of the array of FIG. 1 taken along the diameter of the array having the detailed antennas.
Figure 3:
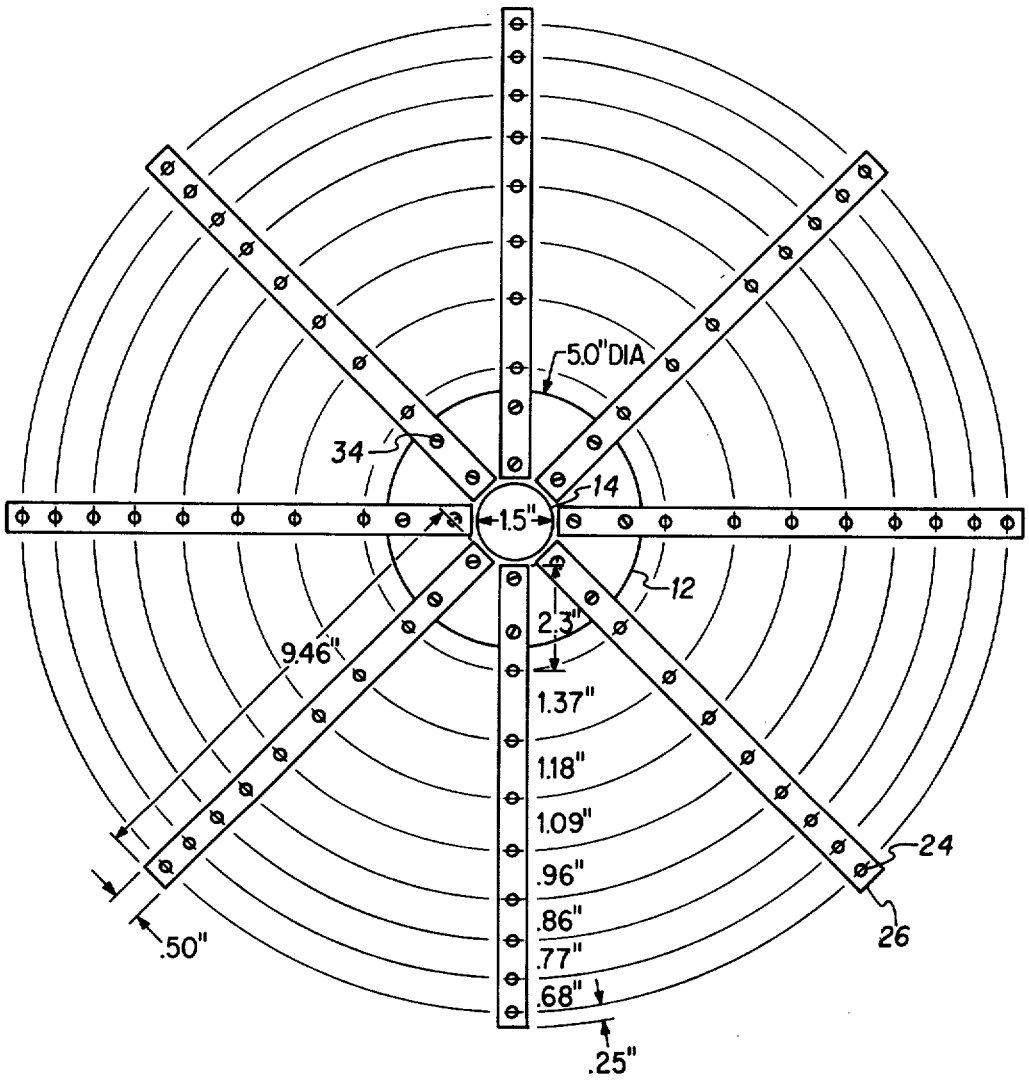
FIG. 3 is a plan view of the array of FIG. 1.

The dimensions depicted in FIGS. 2 and 3 are for an actual antenna array comprising the eight, sixteen dipole element (eight dipole pairs) antennas of FIG. 1 which was built and tested and that exhibited an acceptable maximum bearing error of 2.5° over a frequency range of 225–400 MHz. The total weight of the antenna array using 0.125 inch diameter brass for the dipoles 24 and plexiglass for the arms 26 and support plate 12 was only 5.62 pounds. As will be appreciated, the actual number of dipoles 24 and antennas 10 are optional dependent on the accuracy desired over the operating frequency range and the degree of resolution sought for the cardioid pattern (more antennas providing a smoother sinusoid for modulating the RF signal).

Figure 4:
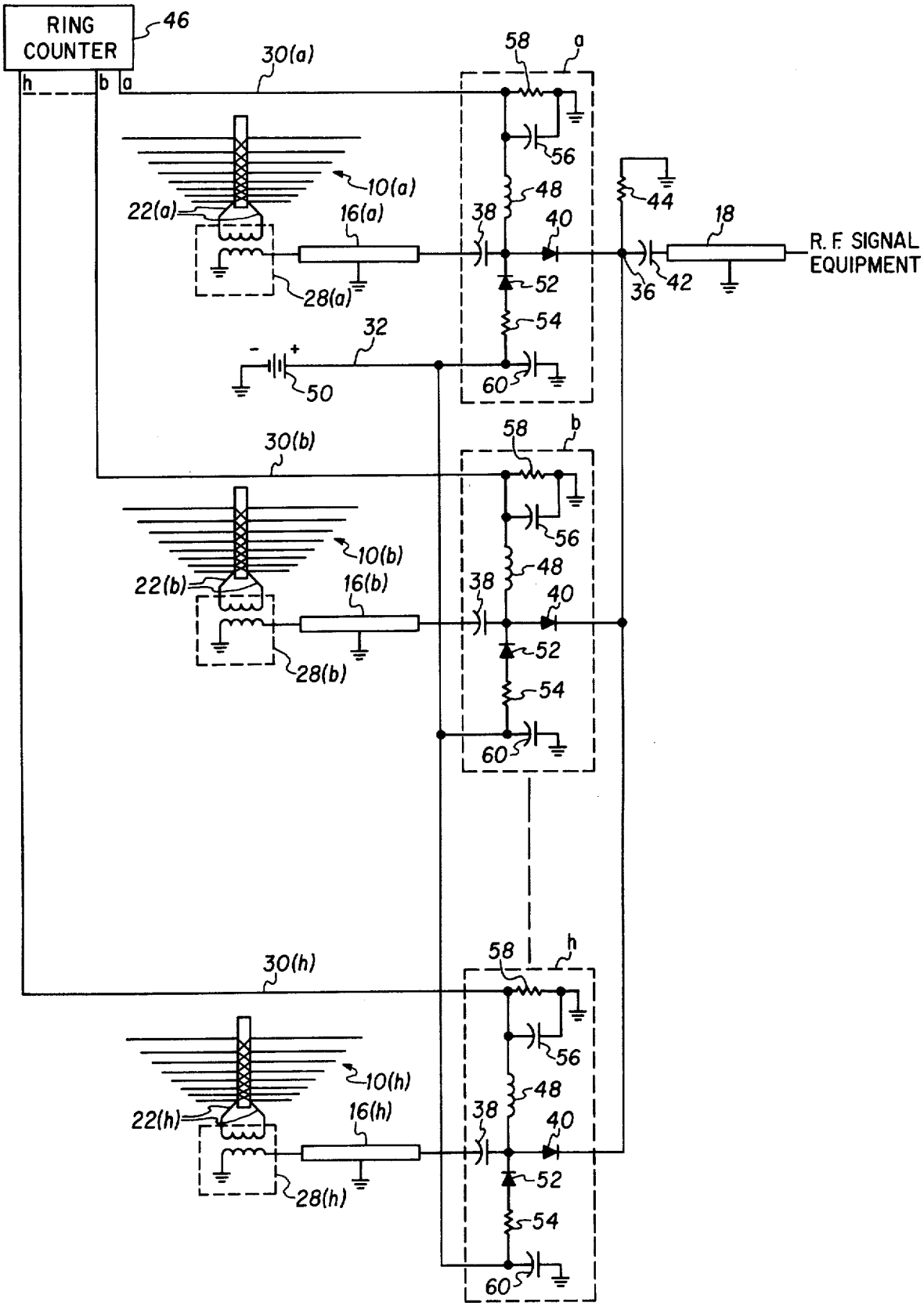
FIG. 4 is a schematic diagram of the switching circuit for effectuating commutation of the antenna array of the invention.

As shown in FIG. 4, each conductor 16 associated with an individual antenna 10 has its own electronic circuitry (circumscribed by dashed line and designated by appropriate letter) housed in enclosure 14 for connecting it to a common terminal 36 via a D.C. blocking capacitor 38 and a series diode 40. The common terminal 36 is connected to the RF signal equipment whether a radio receiver or transmitter via the common conductor 18 and a D.C. blocking capacitor 42. The common terminal 36 is also connected to ground (it being understood that all signals herein are considered as being referenced to ground) through a resistor 44. The junction of capacitor 38 and series diode 40 is connected to a pulse source such as ring counter 46 via an inductor 48 and the associated switching signal lead wire 30 and to the positive terminal of a negatively grounded D.C. source 50 via the D.C. source lead 32 and a shunt diode 52 connected in series with a resistor 54. A capacitor 56 and resistor 58 are connected between ground and the switching signal lead wire 30 while a capacitor 60 is connected between ground and the D.C. source lead 32.

The voltage of the D.C. source 50 is designed to forward bias shunt diode 52 in the absence of a pulse on the associated switching signal lead 30, the current path being via resistors 54 and 58 and inductor 48. This voltage which might be in the order of 1 to 2 volts (only about 0.7 volts being necessary to forward bias shunt diode 52) is sufficiently greater than the antenna signal magnitude, being in the order of microvolts, so that resistor 54 appears as an A.C. load to conductor 16 via capacitor 60 at this time. Although inductor 48 provides a low D.C. path, it is designed to provide a high A.C. impedance at the encountered operating frequencies with respect to resistor 54 so that it can be neglected. And as will be seen shortly, series diode 40 is back biased at this time so as to effectively be an open circuit. Therefore, only resistor 54 acts as an A.C. load on conductor 16 at this time. As is well known, terminating a transmission line such as conductor 16 in a load impedance such as resistor 54 rather than an open circuit reduces wave reflections and consequently when used as herein reradiation effects which would otherwise create interaction problems among juxtaposed antennas. If the resistance of resistor 54 is made equal to the output impedance of the series combination of antenna 10 and conductor 16 the wave reflections can be eliminated entirely. The log periodic antenna which has a constant impedance over large frequency ranges lends itself very nicely to this, permitting a single valued terminating impedance such as fixed resistor 54 to be connected to an antenna 10 via its associated conductor 16 during its non-commutation period (disconnected from common terminal 26). To further ameliorate interaction effects during this non-commutation period, any A.C. signal which may pass through inductor 48 is essentially grounded out by capacitor 56.

During the commutation period when it is desired to connect an antenna 10 to the RF signal equipment via conductor 18, the associated series diode 40 is forward biased by a positive pulse applied to its associated switching signal lead 30, the current path from ring counter 46 being through inductor 48 and resistor 44. A sufficiently large pulse voltage such as 5 volts may be used to forward bias the series diode 40 while simultaneously reverse biasing the shunt diode 52 so that terminating resistor 54 cannot act as an A.C. load at this time which would otherwise attenuate the desired signal. Since this pulse is sequentially applied to the various signal leads 30, one at a time, it also serves to reverse bias all seven of the series diodes 40 associated with the seven non-commutated antennas 10 via the series diode 40 of the commutated antenna 10. Thus, the terminating resistors 54 associated with these other seven antennas 10 are connected to their respective conductors 16 via their shunt diodes 54 so as to provide terminating impedances for reducing wave reflections during their non-commutated period.

Despite its relative diminutive size (the tested antenna presented herein occupies a cylindrical volume whose diameter and height are no more than 21 and 25 inches, respectively) and simplicity in commutative switching, the commutated antenna array of the invention was found to perform quite reliably. Pattern distortion problems arising from interaction effects produced by reradiated signals which would have rendered the pattern unusable proved to be inconsequential even in view of the close proximity of adjacent antennas. In this connection, it should be noted that the longest and closest dipoles (12.46 inches) on adjacent antennas are only 2.5 inches apart which is less than one twentieth of the wavelength for the corresponding frequency of 225 MHz which is substantially less (amounting to twenty times less) than the minimum unit wavelength separation recommended in the literature such as found at section 4.2 on page 198 of a May 1966 publication (DCAC 330-175-1, Addendum No. 1) by the Defense Communications Agency entitled "DCS Engineering — Installation Standards Manual, Addendum No. 1 MF/HF Communications Antennas". Moreover, the high gain, directivity and broadband constant impedance characteristics of the log periodic antenna render it eminently suited for use in a direction finding antenna array. Since modifications to the foregoing Detailed Description, not constituting departures from the scope and spirit of the invention, may occur to those skilled in the art, the description is intended to be merely exemplary and not circumscriptive of the invention as will now be claimed hereinbelow.

What is claimed is:

1. A commutated antenna array for amplitude modulating an RF signal to generate a cardioid pattern for use in automatic direction finding, comprising:

a plurality of log periodic antennas, each having coplanar parallel dipoles, arranged as equiangularly spaced radii in a circular geometric pattern with all the antenna dipoles being perpendicular to the plane of the circle;

a plurality of conductors, there being one connected to each antenna;

a common terminal for connection to radio signal equipment, and commutating means for sequentially connecting said antennas to said common terminal via their respective conductors.

2. The antenna array of claim 1 including a plurality of terminating means, there being one for each conductor for reducing wave reflections when connected thereto and wherein said commutating means includes means for connecting said conductors to their associated terminating means when not connected to said common terminal.

3. The antenna array of claim 2 wherein each of said terminating means is a resistor whose resistance is equal to the output impedance of the series combination of the associated conductor and antenna.

4. The antenna array of claim 2 wherein said commutating means comprises a pair of diodes for each conductor, one connected in series and the other in shunt with the associated conductor wherein the series diode is D.C. forward biased to connect the conductor to said common terminal and the shunt diode is D.C. forward biased to connect the conductor to its associated terminating means and disconnect it from its associated terminating means.

5. The antenna array of claim 1 wherein the distance separating the closest dipoles on adjacent antennas is less than one unit wavelength for the R.F. signal operating frequency.

* * * * *